US011148029B1

(12) United States Patent
Bakic

(10) Patent No.: US 11,148,029 B1
(45) Date of Patent: Oct. 19, 2021

(54) LEG BAND TRAINER

(71) Applicant: Danielle Bakic, Argyle, TX (US)

(72) Inventor: Danielle Bakic, Argyle, TX (US)

( * ) Notice: Subject to any disclaimer, the term of this patent is extended or adjusted under 35 U.S.C. 154(b) by 0 days.

(21) Appl. No.: 17/230,749

(22) Filed: Apr. 14, 2021

(51) Int. Cl.
*A63B 69/00* (2006.01)
*A63B 69/12* (2006.01)

(52) U.S. Cl.
CPC ..... *A63B 69/0062* (2020.08); *A63B 69/0059* (2013.01); *A63B 69/12* (2013.01); *A63B 2209/10* (2013.01); *A63B 2225/605* (2013.01); *A63B 2244/20* (2013.01)

(58) Field of Classification Search
CPC . A63B 69/0062; A63B 69/12; A63B 69/0059; A63B 2209/10; A63B 2244/20; A63B 2225/605; A63B 31/00–18; A63B 60/0057; A63B 23/0211
See application file for complete search history.

(56) References Cited

U.S. PATENT DOCUMENTS 1,192,650 A 7/1916 Leitner
1,329,073 A 1/1920 Czicziriga
4,541,810 A * 9/1985 Wenzel ..... A63B 31/11 441/64
5,649,845 A * 7/1997 Fechtner ..... A63B 31/11 440/101
5,839,122 A 11/1998 Dicker
9,199,126 B1 * 12/2015 Martin ..... A63B 31/14
9,259,632 B2 2/2016 DiLorenzo
9,561,401 B2 * 2/2017 Wiseman ..... A63B 31/11
9,993,689 B1 * 6/2018 Wolbert ..... A63B 31/11
10,065,078 B2 * 9/2018 Martino ..... A63B 31/08
10,350,457 B2 * 7/2019 Ducharme ..... A63B 31/11
10,596,434 B2 * 3/2020 Frank ..... A63B 69/0059
2005/0176315 A1 * 8/2005 Lundquist ..... A63B 31/12 441/60
2008/0108259 A1 * 5/2008 Melius ..... A63B 31/11 441/64
2012/0053021 A1 * 3/2012 Sherstnev ..... A63B 69/12 482/55
2014/0199902 A1 * 7/2014 Suciu ..... A63B 31/11 441/64
2015/0343268 A1 * 12/2015 Wiseman ..... A63B 31/11 441/64
2017/0144027 A1 * 5/2017 Wiseman ..... A63B 31/11
2017/0151465 A1 * 6/2017 Browning ..... A63B 31/11
2017/0189759 A1 * 7/2017 Browning ..... A63B 31/11
2018/0161628 A1 * 6/2018 Kim ..... A63B 31/10

* cited by examiner

*Primary Examiner* — Andrew S Lo
(74) *Attorney, Agent, or Firm* — CARR Law Firm PLLC

(57) ABSTRACT

The present invention provides for an apparatus and a method for maintaining the position of a swimmer's legs and limiting the range of motion of the swimmer's knees when swimming.

30 Claims, 19 Drawing Sheets

LEG BAND TRAINER

FIELD OF THE INVENTION

The present invention relates to swimming aids, more particularly, to training, teaching, improving, increasing and/or correcting swimmer strength, form, body position, and/or technique.

BACKGROUND

Consistent repetition and practice can help swimmers build strength and muscle memory to increase and enhance performance, proper swimming form, body position, and technique. Oftentimes, and particularly with young children who are just learning to swim, technique and form preferably is consistently repeated in subsequent practice sessions.

SUMMARY

The present invention provides method and apparatus promoting consistent repetition of proper kicking form, body position, and leg strength.

BRIEF DESCRIPTION OF THE DRAWINGS

For a more complete understanding of the present invention and the advantages thereof, reference is now made to the following Detailed Description taken in conjunction with the accompanying Drawings, in which.

DETAILED DESCRIPTION

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail.

Figure 1:
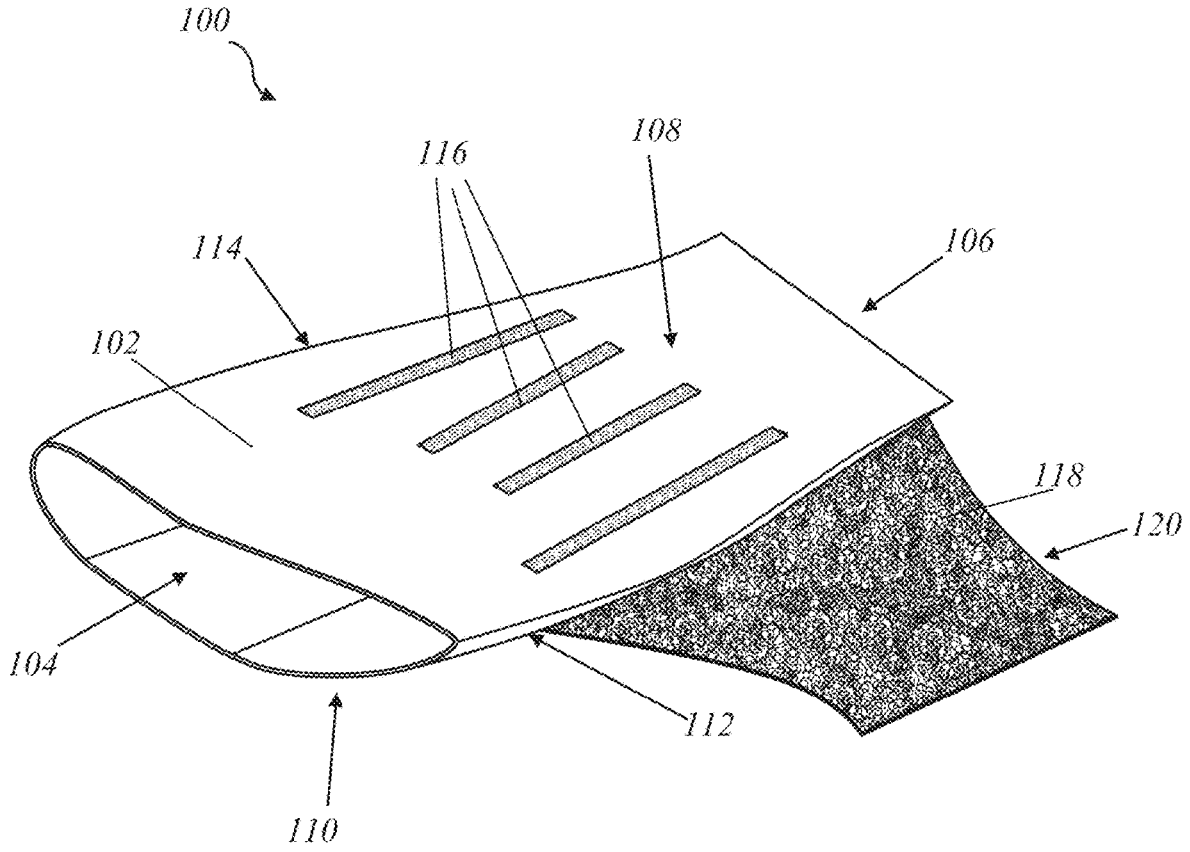
FIG. 1 shows a perspective view of a leg band.

Turning to FIG. 1, an embodiment of a leg band 100 is shown for maintaining the positioning of the legs and limiting the bending of the knees of the swimmer 200 when swimming. The leg band 100 may comprise a band body 102 having the shape of a hollow cylindrical sleeve. The band body 102 may further comprise a first opening 104 on one end, a second opening 106 on the opposite end, a top side 108, a bottom side 110, a first lateral side 112, a second lateral side 114, a plurality of resilient support members 116 extending between the openings 104 and 106 of the band body 102, and a securing strap 118 extending from the first lateral side 112.

In an embodiment, the leg band 100 may be constructed at least in part from semi-elastic material such as neoprene. The semi-elastic material may provide a compressive tension or force to grip the legs of the swimmer when the leg band 100 is put on to assist in preventing the leg band 100 from inadvertently coming off or slipping from the intended placement on the legs when the leg band 100 is in use. Alternatively, the leg band 100 may be constructed of other elastic or semi-elastic material that may be used in water, including, but not limited to various elastomeric materials, and the like. Although the embodiment described is elastic, portions of the band may be manufactured from inelastic or less elastic material, alternatively.

Figure 2:
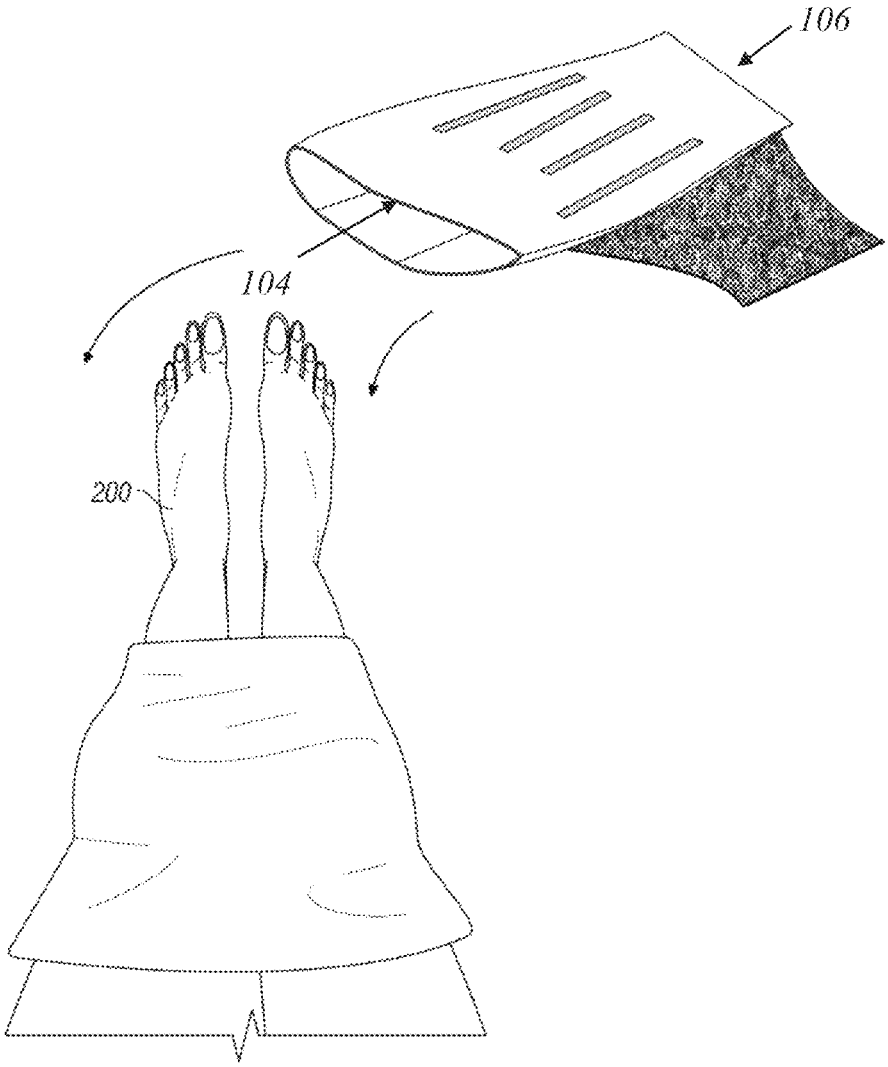
FIG. 2 shows the leg band being put on by a swimmer.

As shown in FIG. 2, to put on the leg band 100, the legs of the swimmer 200 may extend through the band body 102 feet first and through the first and second openings 104, 106. Said another way, the leg band 100 may be drawn over the legs, feet first.

Figure 3A:
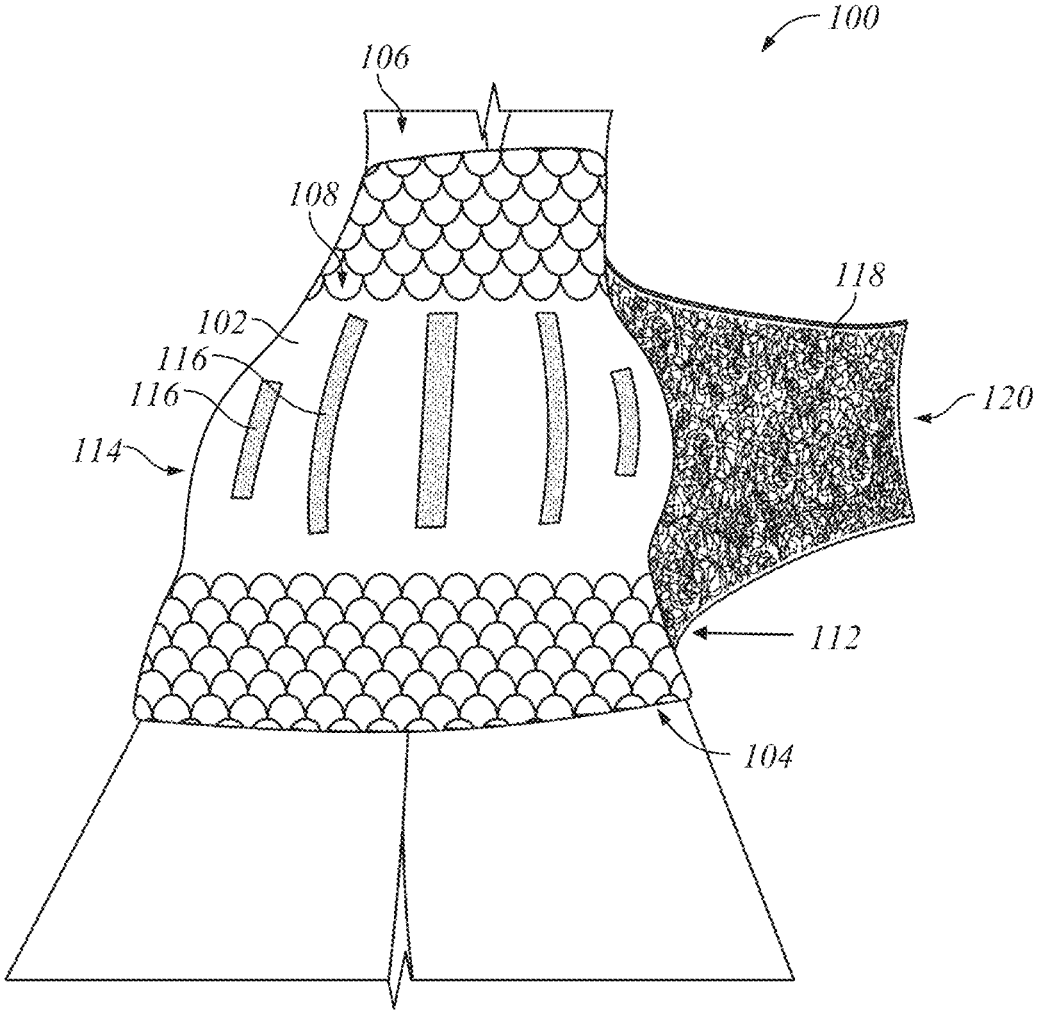
FIGS. 3A-3B show an embodiment of the leg band with a fish scale design in an open and wrapped position.
Figure 3B:
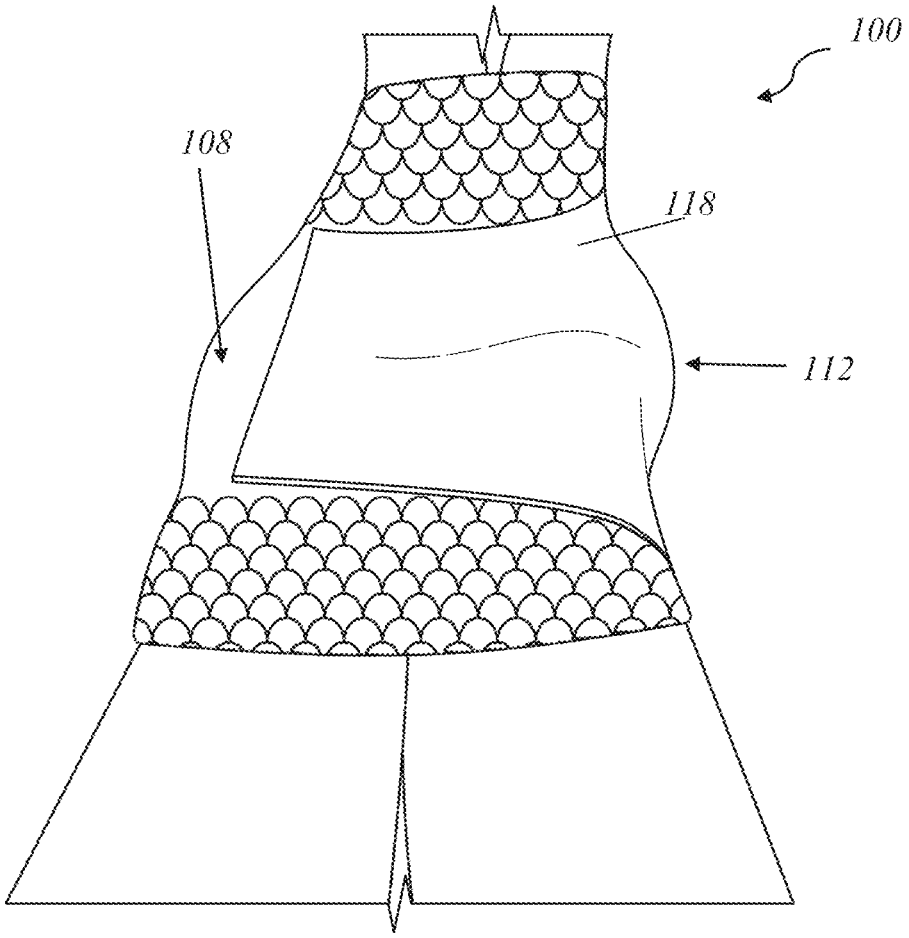

Turning to FIGS. 3A-3B, an embodiment of the leg band 100 with a fish scale design is shown. The exterior surface of the leg band 100 may be decorated with various different designs, patterns and prints, including but not limited to mermaid and marine life prints.

As shown in FIG. 3B, the securing strap 118 may be used secure the leg band 100 around the legs of the swimmer 200 and may also be used to tighten and remove any remaining slack between the band body 102 and the knees of the swimmer 200 when the leg band 100 is put on. The securing strap 118 may also be used to further assist the swimmer 200 to maintain proper leg position and form by keeping the knees and legs of the swimmer 200 together when the swimmer 200 is swimming. In an embodiment, the securing strap 118 may extend from the first side 112 of the band body 102. To secure the leg band 100 around the legs of the swimmer 200 using the securing strap 118, the securing strap 118 may be pulled across the top side 108 of the band body 102 towards the second lateral side 114 and secured to the exterior of the band body 102 with a mating fastener 120.

In an embodiment, the mating fastener 120 may comprise a hook and loop fastener for removably fastening the securing strap 118 to the top side 108 of the band body 102. The mating fastener 120 for securing the securing strap 118 to the exterior surface of the band body 102 may comprise affixing opposite mating parts of the hook and loop fastener to the securing strap 118 and the exterior surface of the band body 102. In order to affix the securing strap 118 to the exterior of the band body 102 using the hook and loop mating fastener 120, the contacting surface of the securing strap 118 may be coated with one mating portion of the hook and loop fastener. Likewise, the contacting portion along the exterior of the band body 102 may be configured with the opposite mating portion of the hook and loop fastener for mating with the securing strap 118. The opposite mating part of the hook and loop fastener used on the exterior surface of the top side 108 may extend along the entire surface of the top side 108 allow for customizable adjustments and tightening of the leg band 100 using the securing strap 118.

Figure 4:
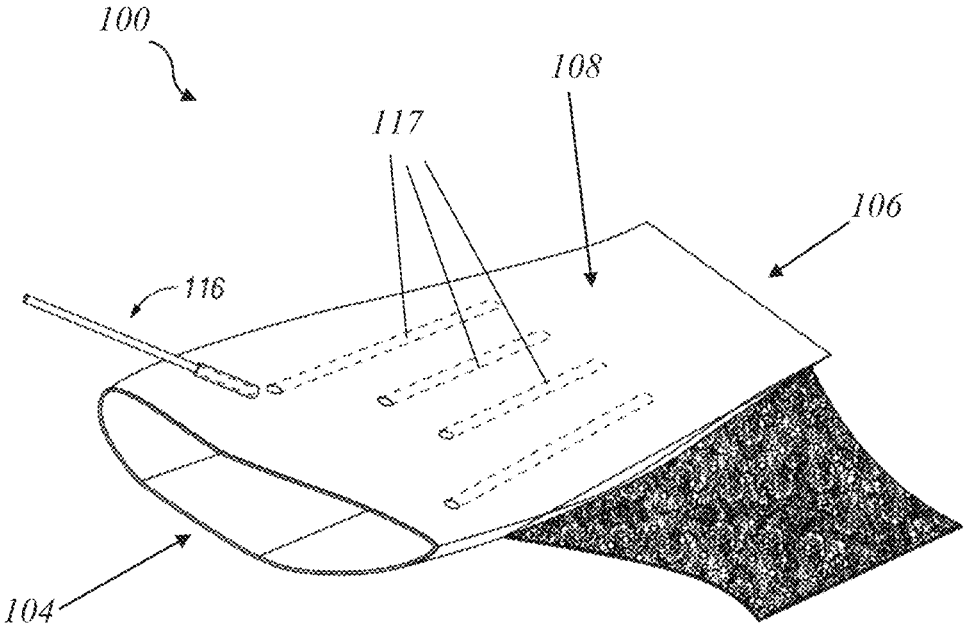
FIG. 4 shows a support member being loaded into a top side of the leg band.

As shown in FIG. 4, the resilient support members 116 may be affixed along a portion of the length of the top side 108 of the leg band 100 and extend longitudinally between the first and second openings 104, 106 of the band body 102. The plurality of resilient support members 116 may be permanently or removably secured to the band body 102 by a waterproof adhesive, bonding, sewn pockets or any type of mechanical fastener such as but not limited to sewing, rivets, hook and loop fasteners, clips, buttons, and the like. In the embodiment shown, the plurality of resilient support members 116 may be loaded into corresponding pockets 117 affixed along the exterior surface of the band body 102. The size and position of each of the corresponding pockets 117 along the band body 102 may vary depending on the size and desired placement of each of the corresponding resilient support member 116 intended to be used with the leg band 100. The plurality of resilient support members 116 may be positioned along at least the section of the band body 102 that is intended to come in direct contact with the knee of the swimmer 200 when the leg band 100 is in use.

In an embodiment, the band body 102 may comprise a plurality of layers to completely encase the plurality of resilient support members 116 between the layers of the band body 102.

Alternatively, in an embodiment, the plurality of later support members 100 may also extend along the entire length of the band body 102. The support members 116 may press against the knees of the swimmer 200 when the leg band 100 is put on and may resist against the flexing of the knees of the swimmer 200, thereby helping to reduce the bending at the knees with each kick and promoting a more streamlined leg position. In addition, the support members 116 may strengthen the legs of the swimmer 200 by adding resistance to kicking. The support members 116 may be composed of plastic, metallic, composite, graphite, or other materials providing spring-like resilient properties.

The number of support members 116 secured to the leg band 100 may be changed to adjust the amount of resistance to kicking or flexing of the knees of the swimmer 200. The length of each support member 116 may also be varied to provide differing resistance to kicking or flexing, such as by providing shorter support members 116 nearer the middle of the top side 108, for example, as is shown in FIG. 1.

The plurality of resilient support members 116 may also be similarly secured to and extend along the first lateral side 112 and the second lateral side 114 of the band body 102 to resist flexing of the knees. The plurality of resilient support members 116 extending along the top side 108 of the band body 102 may also be longer than the resilient support members 116 extending along the first and second lateral sides 112, 114. Alternatively, the plurality of resilient support members 116 may all be the same length and/or extend along all sides of the band body 102.

In some instances, adjusting the leg band 100 to allow at least a slight or greater bend of the knees of the swimmer 200 may be more desirable to allow the swimmer 200 to kick faster and with a greater range of movement while training with the leg band 100. The ease of the swimmer 200 bending her knees and the range of knee flexion and extension when using the leg band 100 may be increased by correspondingly decreasing the degree of resistance to knee flexion of the swimmer 200 by reducing the tightness of the leg band 100 around the knees and reducing the number, size, length and/or resilience of the resilient support members 116. By shortening the length of the leg band 100 around the knees, the leg band 100 may be tightened to resist knee flexion during kicking. Conversely, lengthening the leg band 100 around the knees may loosen the leg band 100 about the knees, thereby reducing resistance to flexion during kicking.

The number of support members 116 used with the leg band 100 or the material used for the support members 116 may also or alternatively be varied to change the resistance against the flexing of the knees. Decreasing the number of support members 116, reducing the length, width and/or thickness of the support members, and/or using support members 116 constructed from a more pliable and less resilient material may decrease the degree of resistance and allow more bending of the knees by the swimmer 200. Conversely, increasing the number of support members 116, increasing the length, width and/or thickness of the support members 116, and/or using support members 116 constructed from a less pliable and less resilient material may increase the degree of resistance and allow less bending of the knees by the swimmer 200.

Figure 5:
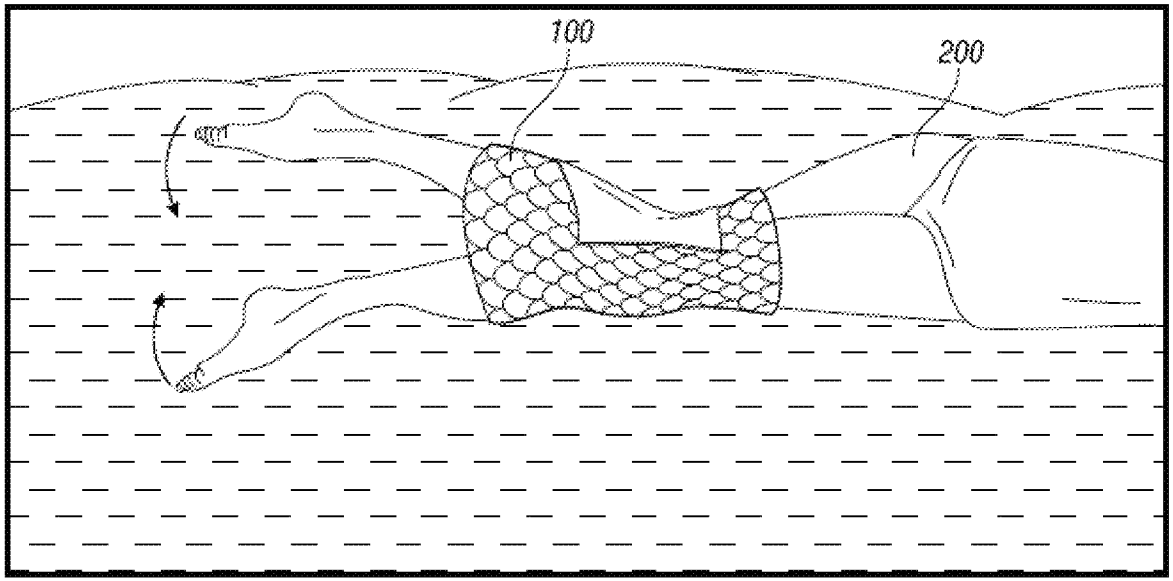
FIG. 5 shows the leg band in use by the swimmer when swimming.
Figure 6:
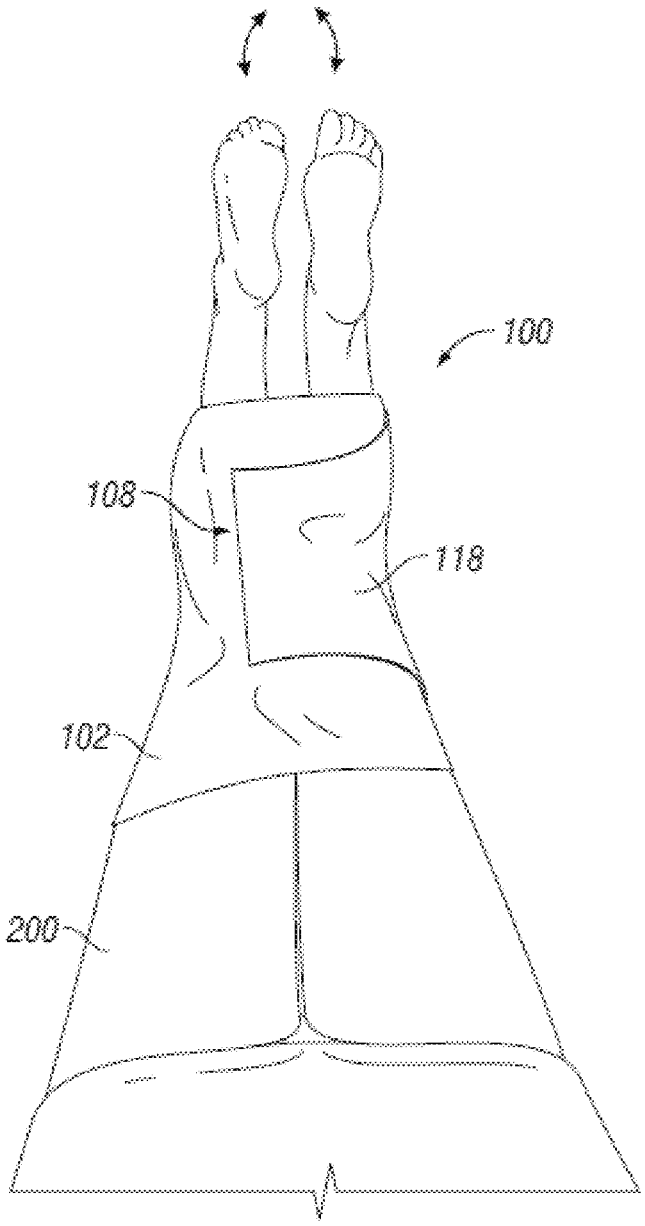
FIG. 6 shows the leg band secured and tightened around the legs of the swimmer.

As shown in FIGS. 5-6, when in use, the leg band 100 may be positioned about the knees of the swimmer 200, with a portion of the length of the leg band 100 extending from the knees over the thigh of each leg and from the knees over the calves of each leg. When the leg band 100 is put on, the leg band 100 may be fitted around the legs of the swimmer 200 to push and keep the legs and knees of the swimmer 200 together. The leg band 100 may be sized such that the band body 102 may extend from the middle part of the thighs of the swimmer 200 to the middle part of the calves of the swimmer 200. To ensure a secure fit when the leg band 100 is in use, the first opening 102 may be sized to snuggly fit around the middle part of the thighs the swimmer 200. The second opening 104 may be sized to snuggly fit around the middle part of the calves of the swimmer 200. When the leg band 100 is fitted on the swimmer 200, the contoured fit of the leg band 100 around the legs of the swimmer 200 may cause the portion of the leg band 100 over the thighs to taper towards the knees of the swimmer. From the knees of the swimmer 200, the leg band 100 may then further taper from the knees to the portion of the leg band 100 over the calves of the swimmer 200.

When the leg band 100 is on, the knees of the swimmer 200 may be fitted completely within the band body 102 with the bottom side 110 of the band body 102 adjacent against the kneecaps of the swimmer 200, and the top side 108 adjacent against the back side of the knees. The first and second lateral sides 112, 114 of the band body 102 may connect the top and bottom sides 108, 110 of the band body 102 and extend along the sides of the legs and knees of the swimmer 200 when in use.

Figure 7:
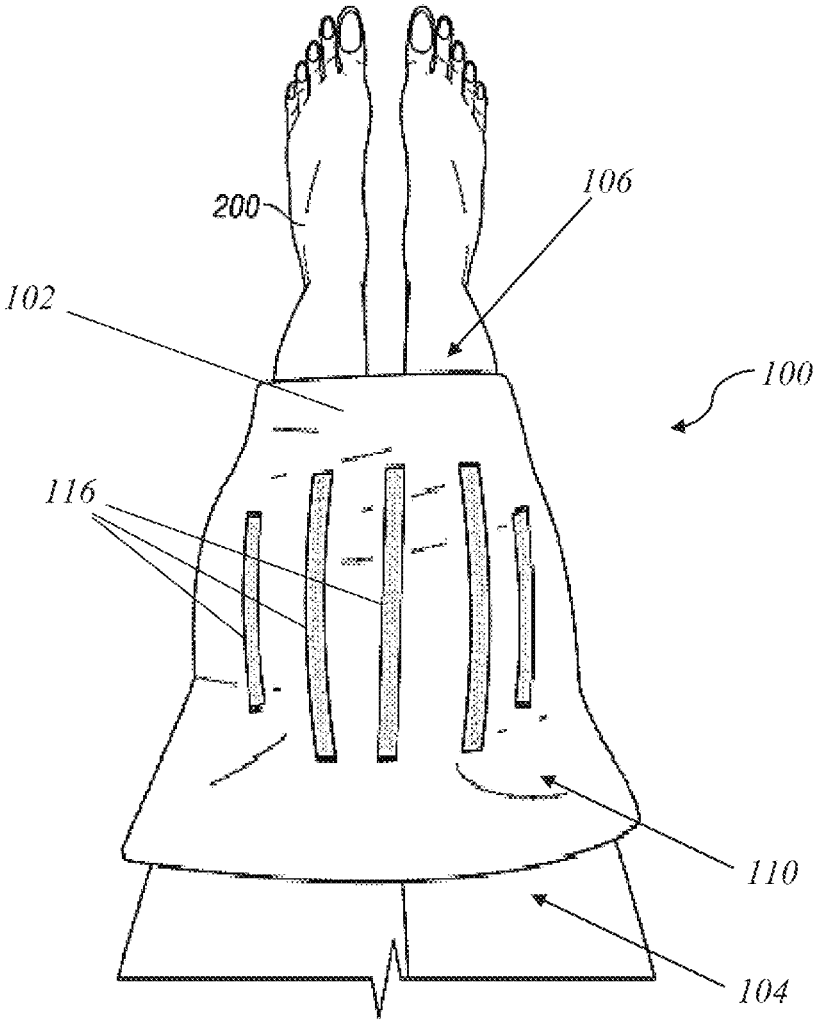
FIG. 7 shows an embodiment of the leg band with a plurality of support members on a bottom side of the leg band.

Alternatively, as shown in FIG. 7, the plurality of resilient support members 116 may be embedded along the bottom side 110 of the band body 102 to resist against and minimize the bending of the knees when the swimmer 200 is swimming with the leg band 100. The extension of the plurality of resilient support members 116 across the front of the knee along the longitudinal axis of the leg also similarly resists the knees of the swimmer 200 from bending.

Figure 8A:
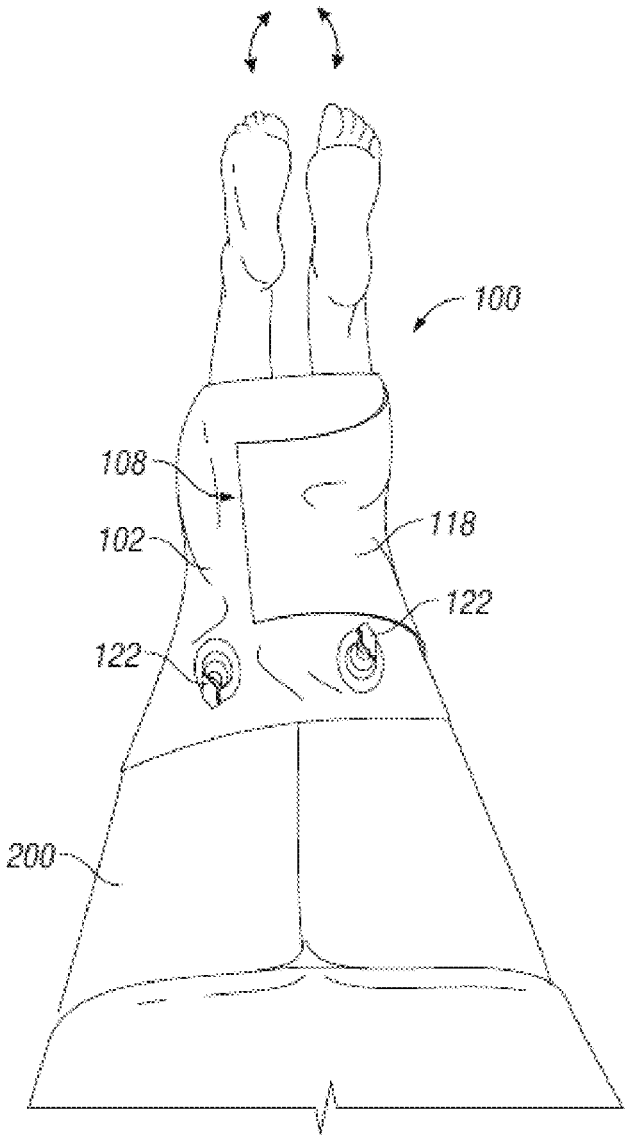
FIGS. 8A-8B show an embodiment of the leg band with a plurality of floats on the top side of the leg band.

Turning to FIGS. 8A-11B, the leg band 100 may further comprise one or more floats 112 to assist in keeping the legs of the swimmer 200 afloat when swimming with the leg band 100. The one or more floats 112 may be positioned on the same side of the band body 102 as the plurality of support members 116. Alternatively, the one or more floats 112 may be positioned on opposite sides of the band body 102 from the plurality of support members 116. As shown in FIGS. 8A-8B, the one or more floats 112 may be positioned along the top side 108 of the band body 102 opposite from the plurality of support members 116 extending along the bottom side 110 of the band body 102, as shown in FIG. 7. With the one or more floats 112 positioned along the top side 108, the one or more floats 112 may be positioned adjacent to and on top of the back of the knees of the swimmer 200 to buoyantly support and hold the legs of the swimmer 200 up near the top of the water. In the embodiment shown, the floats 112 may comprise an inflatable floatie further comprising a blow valve 122 for inflating the floats 112 prior to use. The one or more of the floats 112 may be positioned together along one end of the band body 102, such as near the first opening 104 as shown in FIG. 8A. Alternatively, the one or more floats 112 may be positioned along just the second opening 106, or near both openings 104, 106 as shown in FIG. 8B.

Alternatively, the one or more floats 112 may comprise a buoyant float constructed from a floatable buoyant foam material including but not limited to semi-rigid or resilient plastic foam, buoyant foam, Styrofoam foam, polystyrene foam, polystyrene plastic, closed-cell extruded polystyrene foam, or expanded polystyrene (EPS) foam, and the like.

Figure 8B:
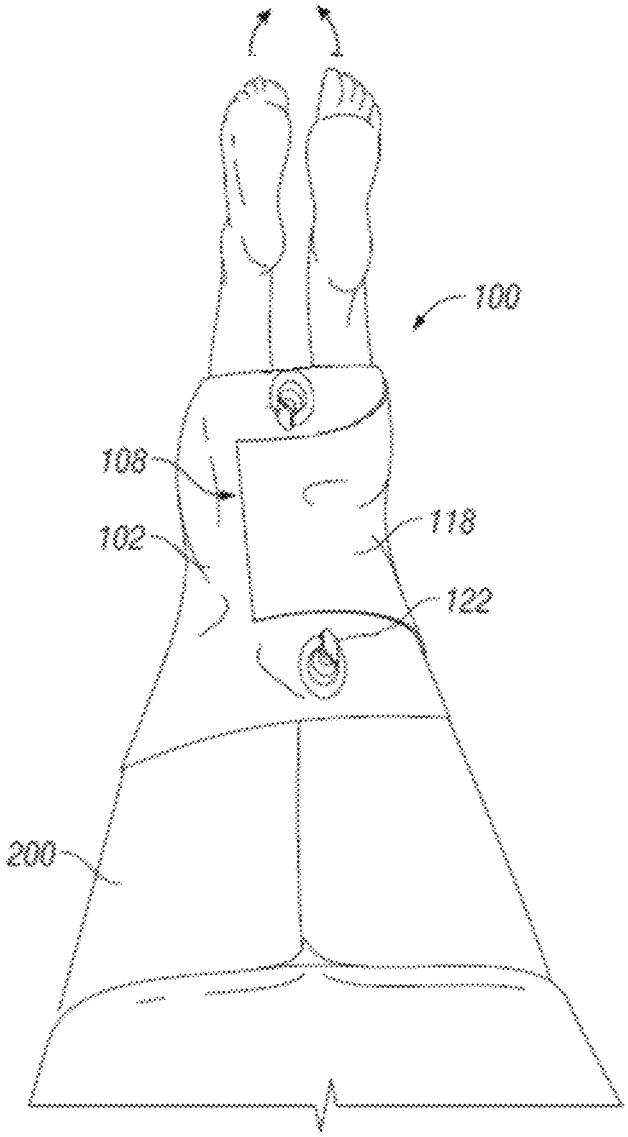
Figure 9A:
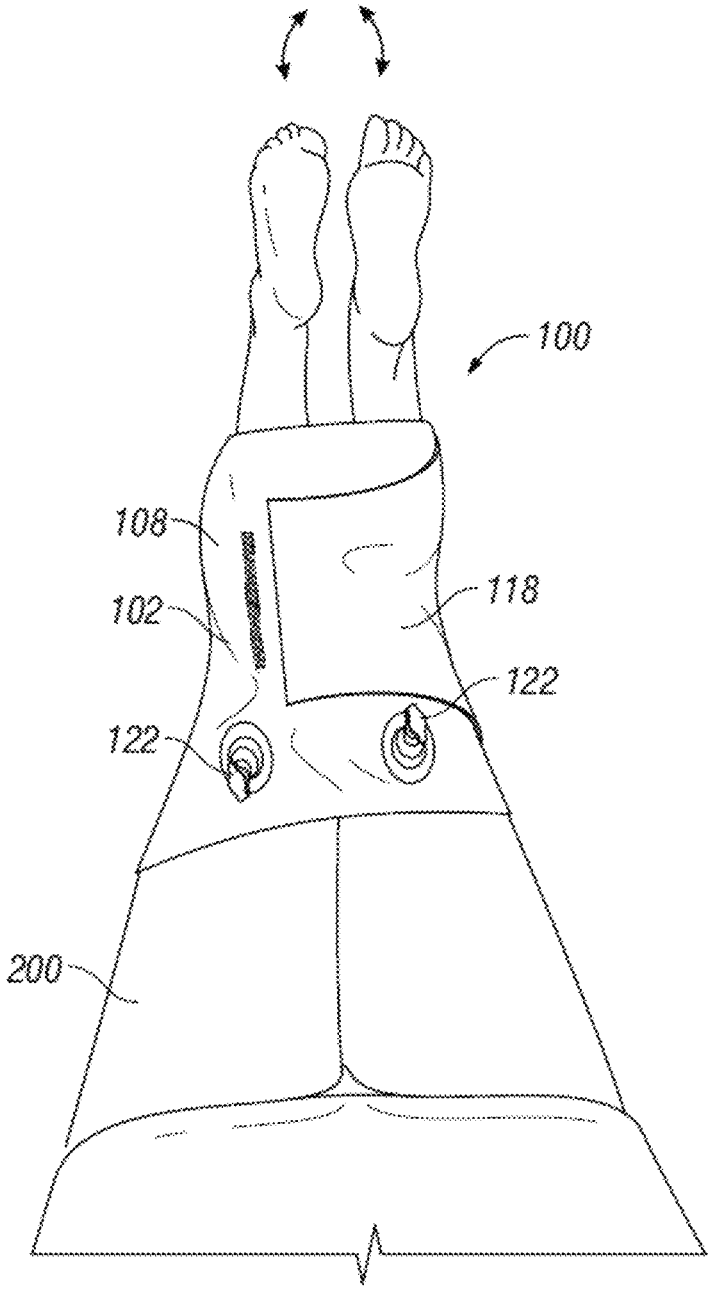
FIGS. 9A-9B shows an embodiment of the leg band with the plurality of support members and floats on the top side of the leg band.
Figure 9B:
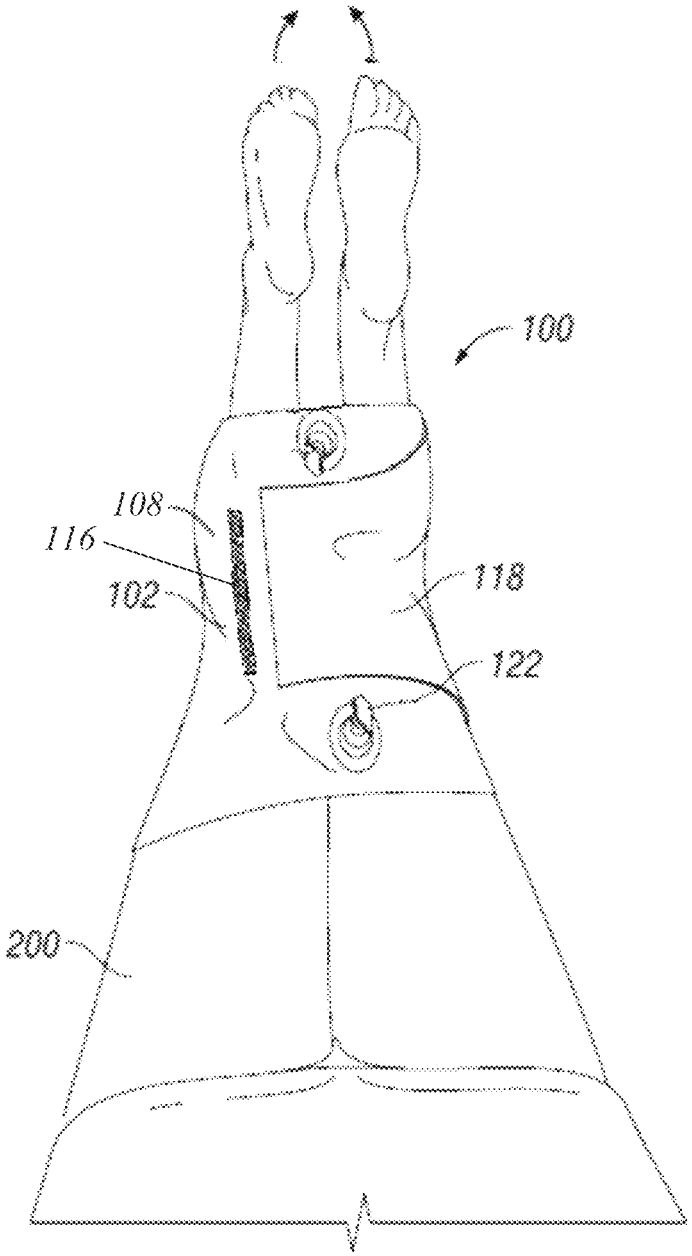

FIGS. 9A and 9B shown an embodiment of the leg band 100 with the plurality of support members 116 and the one or more floats 112 together on the top side 108 of the band body 102. In an embodiment, the one or more of the floats 112 may be positioned together along one end of the band body 102, such as near the first opening 104 as shown in FIG. 9A. Alternatively, the one or more floats 112 may be positioned along just the second opening 106. In the embodiment shown in FIG. 9B, the floats 112 may be positioned near each of the openings 104, 106 as shown in FIG. 8B on opposite sides of the plurality of support members 116.

Figure 10A:
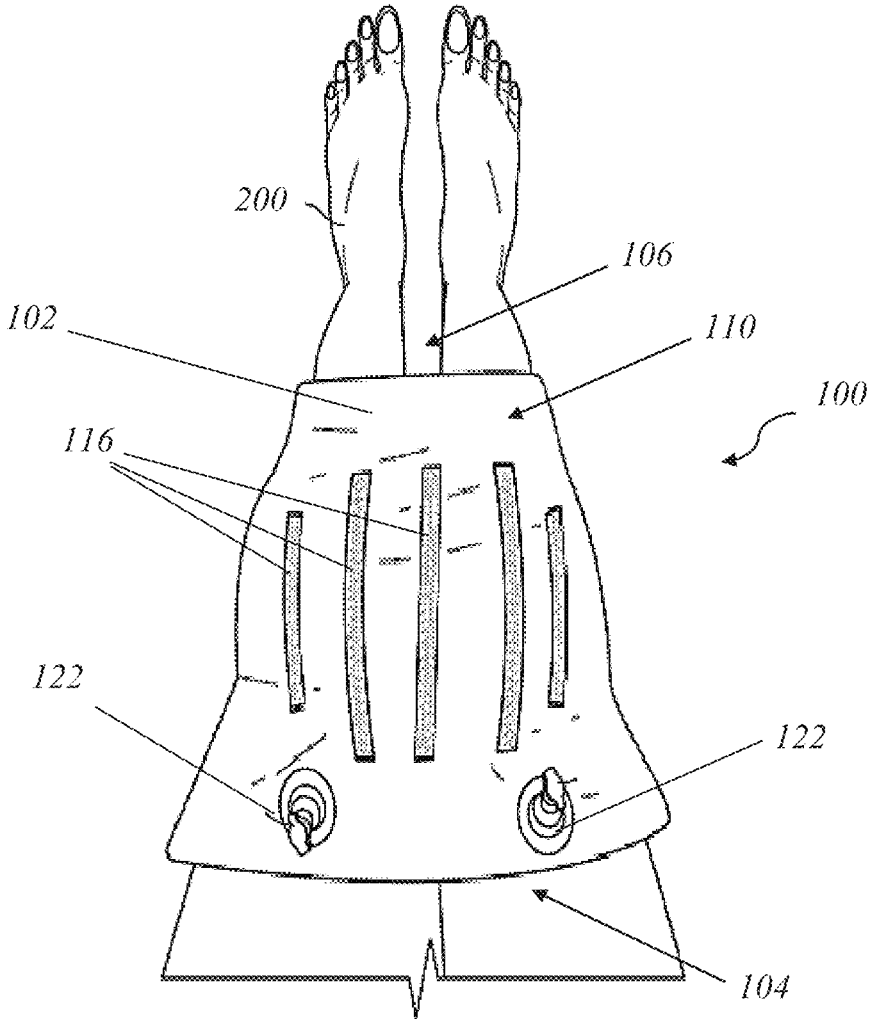
FIGS. 10A-10B shows an embodiment of the leg band with the plurality of support members and floats on the bottom side of the leg band.
Figure 10B:
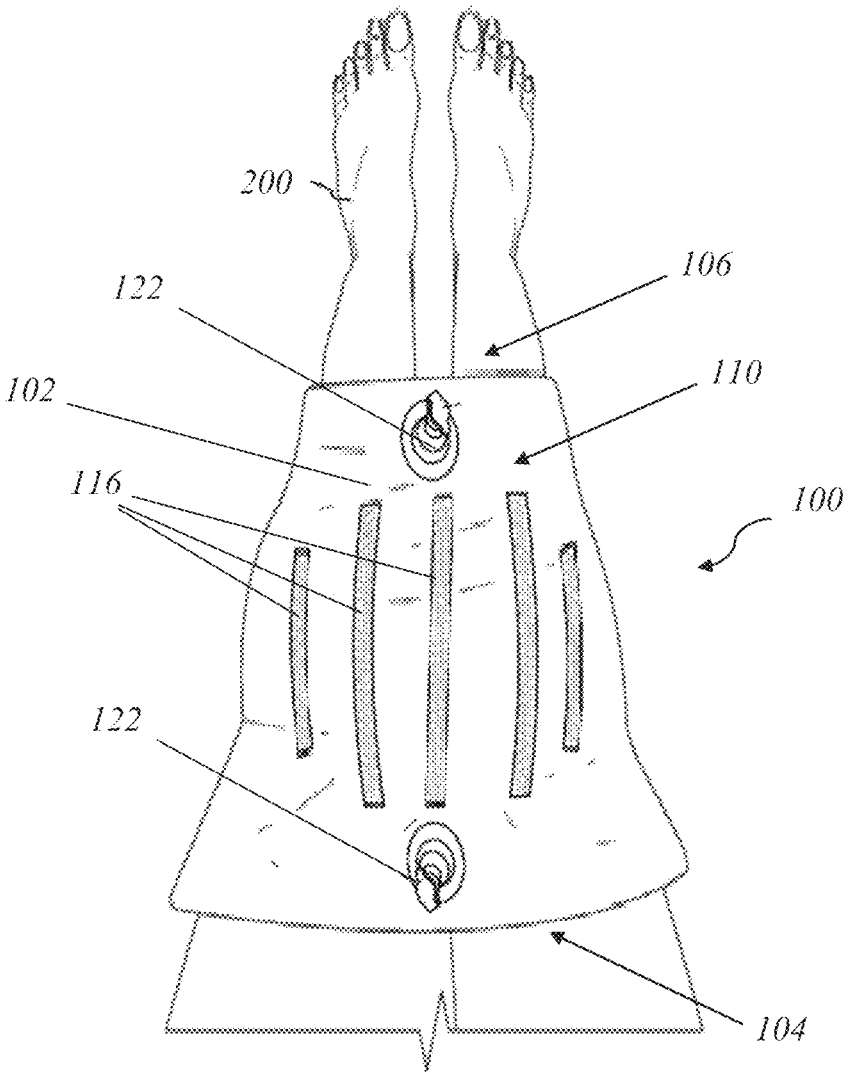

FIGS. 10A and 10B shown an embodiment of the leg band 100 with the plurality of support members 116 and the one or more floats 112 together on the bottom side 110 of the band body 102. With the one or more floats 112 positioned along the bottom side 110, the one or more floats 112 may be positioned adjacent to and underneath the top of the knees of the swimmer 200 to buoyantly support and hold the legs of the swimmer 200 up near the top of the water. In an embodiment, the one or more of the floats 112 may be positioned together along one end of the band body 102, such as near the first opening 104 as shown in FIG. 10A. Alternatively, the one or more floats 112 may be positioned along just the second opening 106. In the embodiment shown in FIG. 10B, the floats 112 may be positioned near each of the openings 104, 106 on opposite sides of the plurality of support members 116.

Figure 11A:
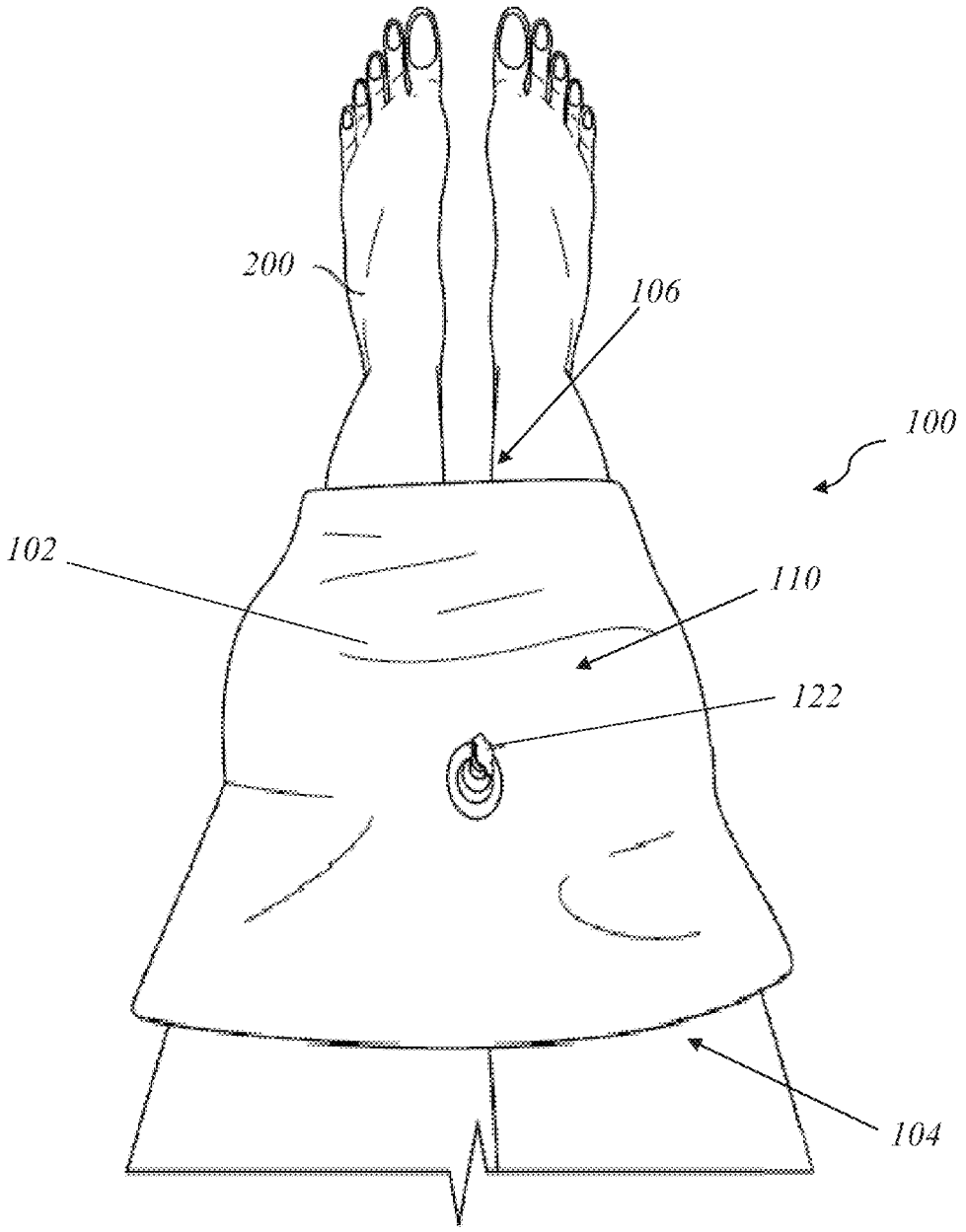
FIGS. 11A-11B shows an embodiment of the leg band with two floats and one float on the bottom side of the leg band, respectively.
Figure 11B:
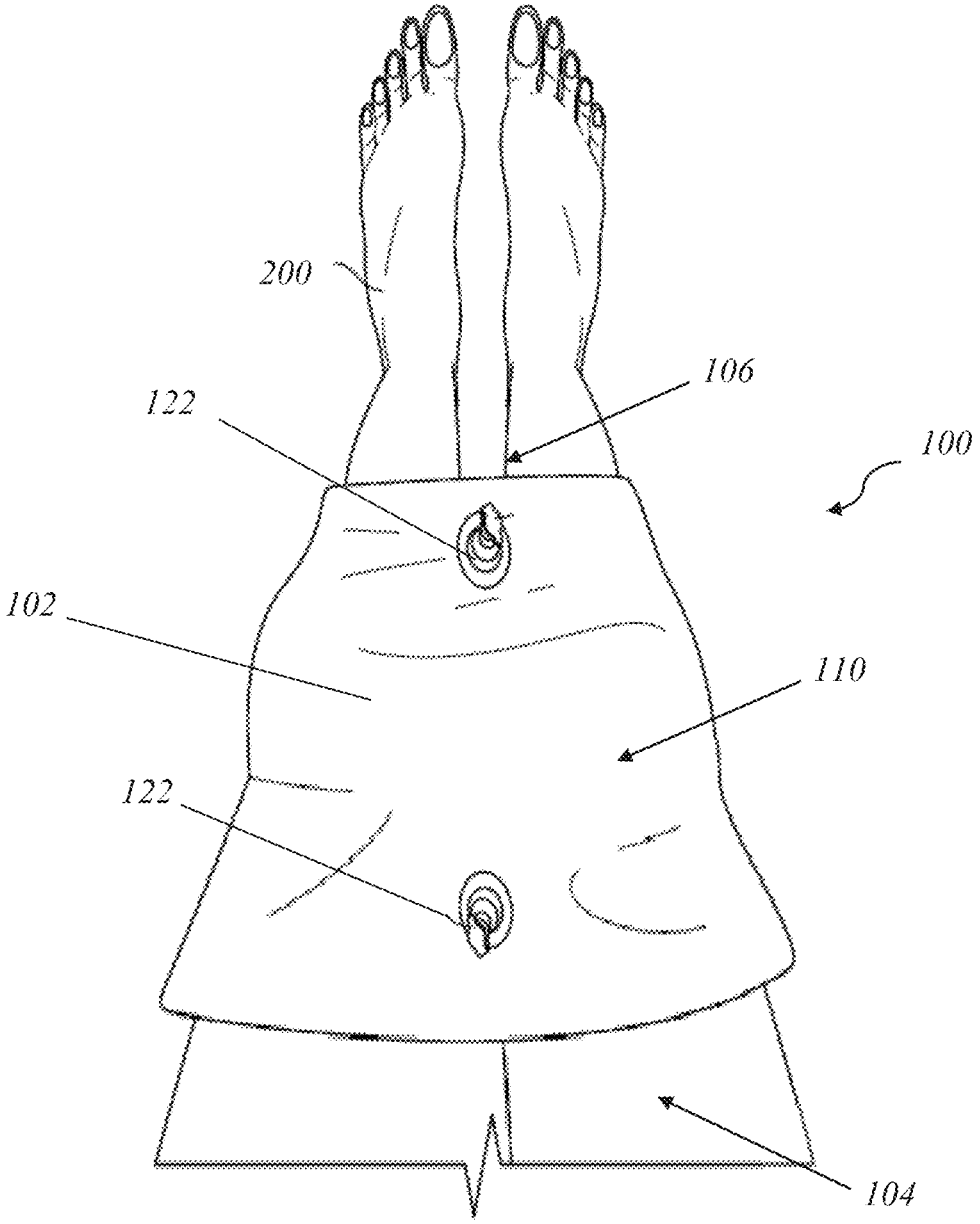

FIGS. 11A and 11B show an embodiment of the leg band 100 with the plurality of support members 116 on the top side 108 of the leg band 100 as in FIG. 1, and the one or more floats 112 on the bottom side 110 of the band body 102. In an embodiment, the one or more of the floats 112 may be positioned near just one of the ends 104, 106 of the leg band 100, or along the middle portion of the band body 102, as shown in FIG. 11A. In the embodiment shown in FIG. 11B, the floats 112 may be positioned near each of the openings 104, 106. Alternatively, the one or more floats 112 may be positioned across the entire bottom surface 110 of the band body 102 along the middle portion of the band body 102 as well as near each of the openings 104,106.

Figure 12A:
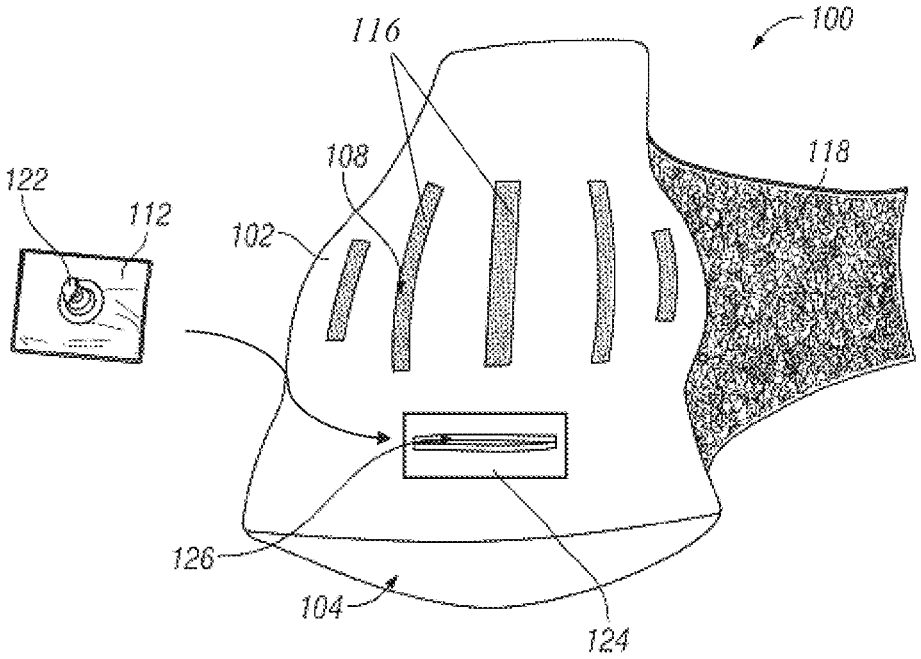
FIGS. 12A-12B show a float being loaded into a pocket secured on the top side of the leg band.
Figure 12B:
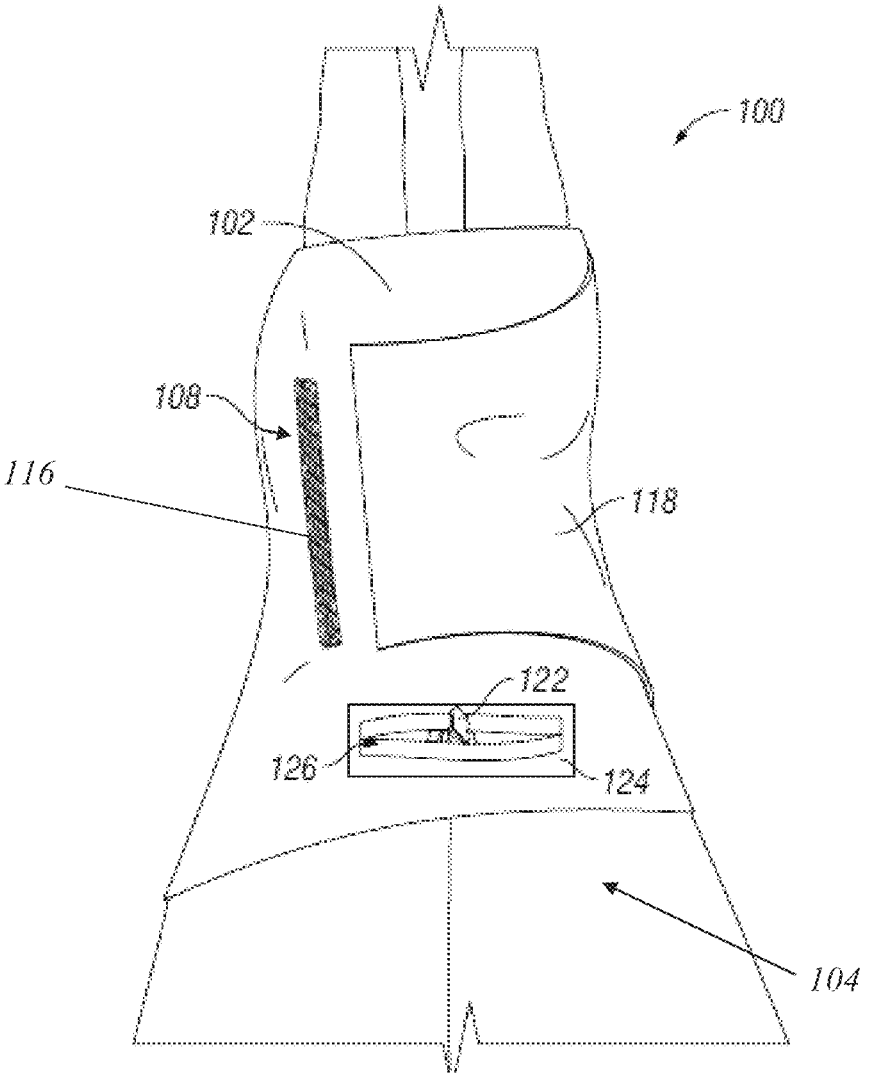
Figure 13:
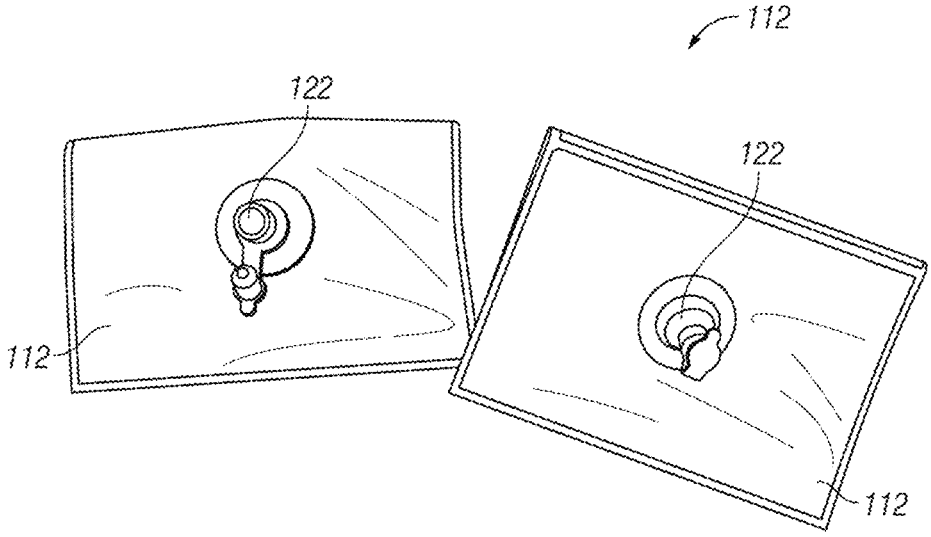
FIG. 13 shows a top view of an embodiment of a pair of inflatable floats for use with the leg band.

As shown in FIGS. 12A and 12B, in an embodiment, the one or more floats 112 may be affixed to the band body 102 by being secured in a pocket 124 formed along the exterior of the top side 108 of the leg band 100. In the embodiment shown in FIGS. 12A and 12B, only one float 112 is used with the leg band 100. Alternatively, more than one float 112 may be used. The float 112 may be affixed to the leg band 100 by being inserted into a slit 126 in the pocket 124. The slit 126 in the pocket 124 may be sized such that the float 112 may only fit through the slit 126 when deflated. As such, to use the float 112, the float 112 may first be inserted into the pocket 124 through the slit 126 prior to being inflated.

As shown in FIG. 12B, when the deflated float 112 is positioned within the pocket 124, the blow valve 122 may extend outwards through the slit 126 to allow the valve 122 to be accessed to inflate the float 112. Once inflated, the expanded float 112 would temporarily be too big to fit through the slit 126 and would therefore be secured within the pocket 124 and affixed along the exterior of the top side 108 of the band body 102. Once the float 112 is deflated, the float 112 may once again re-fit through the slit 126 and may then be removed from the pocket 124 of the leg band 100. Alternatively, the one or more float 112 may be formed as an integral part of the band body 102 along the top side 108. In an embodiment where a non-inflatable buoyant float is used, the buoyant float may be secured using a pocket capable of being opened and closed with a fastener for insertion and removable of the buoyant float.

When the leg band 100 is used by the swimmer 200, the leg band 100 may provide support and tension to minimize the spacing between the legs and limit the bending of the knees of the swimmer 200 when the swimmer 200 is swimming. If the floats 112 are used with the leg band 100, the floats 112 may assist in keeping the legs of the swimmer 200 near the top of the water to train the swimmer 200 to engage and use more hip flexors when kicking. In swimming, proper use of hip flexors may assist in maintaining a compact and steady kick which in turn can translate into less splashing and more power with each kick.

Having thus described the present invention by reference to certain of its exemplary embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of exemplary embodiments. Accordingly, it is appropriate that any claims supported by this description be construed broadly and, in a manner consistent with the scope of the invention.

I claim:

1. An apparatus for swim training, comprising:

a band body forming a first opening at an upper end of the band body and a second opening at a lower end of the band body, wherein the band body is configured to receive a lower left extremity and a lower right extremity of a swimmer together into the first opening and out the second opening;

at least one resilient support member secured to the band body and extending longitudinally a distance between the first and second openings; and a securing strap extending from the band body for tightening the band body around the lower left and right extremities of the swimmer.

2. The apparatus in claim 1, further comprising at least one float secured to the band body.

3. The apparatus in claim 1, wherein the securing strap further comprises a fastener for removably fastening the securing strap around an exterior surface of the band body.

4. The apparatus in claim 1, wherein the at least one resilient support member is configured to provide resistance against the flexing of the lower left and right extremities of the swimmer.

5. The apparatus in claim 1, further comprising at least one support member pocket secured to the band body, wherein the at least one support member is removably secured to the band body by being inserted into the at least one support member pocket.

6. The apparatus in claim 1, wherein a length of the band body is adjustable using the securing strap to urge the lower left and right extremities of the swimmer together at a left and right knee, a portion of a length of a left and right calf, and a portion of a length of a left and right thigh.

7. The apparatus in claim 1, wherein the band body is configured to cover a portion of the lower left and right extremities of the swimmer by extending from a portion of the extremities below a left knee and a right knee of the swimmer to a portion of the extremities above the left and right knees.

8. The apparatus in claim 1, wherein the at least one support member is secured to the band body in a substantially longitudinal orientation along a longitudinal axis extending from the first opening to the second opening.

9. The apparatus in claim 1, wherein the at least one support member is comprised of plastic, metallic, composite, or graphite materials.

10. The apparatus in claim 1, wherein the band body comprises at least in part an elastomeric or a semi-elastic material configured to allow flexion of a left and right knee of the swimmer while urging the left and right extremities together.

11. The apparatus in claim 1, wherein the band body comprises at least in part neoprene configured to allow flexion of a left and right knee while urging the left and right extremities together.

12. The apparatus in claim 1, further comprising a graphic design disposed on an exterior surface of the band body facing outwardly and away from the left and right extremities.

13. The apparatus in claim 1, wherein the band body and the securing strap comprises at least in part of water-proof material.

14. The apparatus in claim 2, wherein the at least one float is configured to provide buoyancy to the band body and the lower left and right extremities of the swimmer.

15. The apparatus in claim 2, further comprising at least one float pocket secured to the band body, wherein the at least one float pocket is configured to removably secure the at least one float within the pocket.

16. The apparatus in claim 2, wherein the at least one float is comprised of an inflatable floatie, floatable foam, polystyrene foam, polystyrene plastic, closed-cell extruded polystyrene foam, or expanded polystyrene foam.

17. The apparatus in claim 3, wherein the fastener and the exterior surface of the band body comprises corresponding parts of a hook and loop fastener.

18. A method for limiting the range of motion of a lower left and right extremity of a swimmer, comprising:

wrapping a leg band around the lower left and right extremities of the swimmer, wherein the leg band extends from below a left and right knee of the swimmer to a portion of the extremities above the left and right knees;

pressing at least one resilient support member secured to the leg band against the left and right knees of the swimmer; and fastening a securing strap around the leg band to tighten the leg band around the lower left and right extremities of the swimmer.

19. The method in claim 18, further comprising the at least one resilient support member resisting against the flexing of the lower left and right extremities of the swimmer.

20. The method in claim 18, further comprising the leg band resisting against the spreading of the lower left and right extremities.

21. The method in claim 18, further comprising changing the resistance by the at least one resilient support member against the flexing of the lower left and right extremities of the swimmer by changing a number of, a length of, a width of, a thickness of, or a material of the at least one resilient support member pressing against the left and right knees of the swimmer.

22. The method in claim 18, further comprising the at least one resilient support member pressing against the left and right knees of the swimmer extending in a substantially longitudinal orientation along a longitudinal axis of the lower left and right knees of the swimmer.

23. The method in claim 18, further comprising decreasing a length of the leg band and urging the lower left and right extremities of the swimmer together at the left and right knees, a portion of a length of a left and right calf and a portion of a length of a left and right thigh by tightening the securing strap around the leg band.

24. The method in claim 18, wherein the at least one support member pressing against the left and right knees of the swimmer comprises of plastic, metallic, composite, or graphite materials.

25. The method in claim 18, wherein the leg band wrapping around the lower left and right extremities of the swimmer comprises of at least in part an elastomeric or a semi-elastic material.

26. The method in claim 18, wherein fastening the securing strap around the leg band comprises removably fastening the securing strap against an exterior surface of the leg band using a hook and loop fastener.

27. The method in claim 18, further comprising securing at least one float to the leg band.

28. The method in claim 27, further comprising the at least one float providing buoyancy to the leg band and the lower left and right extremities of the swimmer.

29. The method in claim 27, wherein securing the at least one float to the leg band comprises securing at least one float pocket to the leg band and inserting the at least one float into the at least one float pocket.

30. The method in claim 27, wherein the at least one float comprises an inflatable floatie, floatable foam, polystyrene foam, polystyrene plastic, closed-cell extruded polystyrene foam, or expanded polystyrene foam.

* * * * *